United States Patent [19]

Lea

[11] 4,073,144

[45] Feb. 14, 1978

[54] ICE REMOVAL SYSTEM

[75] Inventor: James F. Lea, Fayetteville, Ark.

[73] Assignee: Sun Oil Company Limited, Toronto, Canada

[21] Appl. No.: 696,445

[22] Filed: June 15, 1976

[51] Int. Cl.[2] ..... E02B 3/00; B63B 35/08

[52] U.S. Cl. ..... 61/1 R; 61/103; 114/40

[58] Field of Search ..... 61/103, 36 A, 1; 175/5, 175/6, 7; 114/40, 41, 42

[56] References Cited

U.S. PATENT DOCUMENTS

| | | | |
|---|---|---|---|
| 3,370,432 | 2/1968 | Butler et al. | 61/54 |
| 3,664,437 | 5/1972 | McCulloch | 175/5 |
| 3,749,162 | 7/1973 | Anders | 175/5 X |
| 3,837,311 | 9/1974 | Lea | 114/40 X |
| 3,886,882 | 6/1975 | Thornburg et al. | 114/40 |
| 3,929,083 | 12/1975 | Blankenship et al. | 114/40 |

*Primary Examiner*—Jacob Shapiro

*Attorney, Agent, or Firm*—J. Edward Hess; Donald R. Johnson; Stanford M. Back

[57] ABSTRACT

An ice removal system to protect a drill string in an ice covered waterway from possible damage due to ice movement. The drill string extends down into the waterway from a vessel which has an ice melting system for melting ice coming into direct contact with it. If the ice is thicker than the draft of the vessel, the unmelted portion of the ice passing under the vessel is deflected downward by ice breaking ridges surrounding the drill string. The downward deflection causes the ice to fail in tension thereby breaking it up into a plurality of ice blocks. The ice blocks float up into a moon pool surrounding the drill string, and are then flushed out of the moon pool through a channel and into the surrounding waterway. A cylindrical protective plate surrounding the drill string prevents the ice blocks from coming into direct contact with the drill string and thereby possibly damaging it.

10 Claims, 3 Drawing Figures

ICE REMOVAL SYSTEM

BACKGROUND OF THE INVENTION

The present invention relates generally to a system for protecting a drill string from ice movement in ice covered waters.

Geologists presently feel that off-shore regions in the Arctic show great promise for the exploration and production of oil and gas. This expectation is bolstered by major gas and oil finds recently made on land in the vicinity of the MacKenzie Delta and Prudhoe Bay, and by the fact that off-shore areas are usually more productive than adjacent land areas. When off-shore drilling operations are conducted in a temperate zone, conventional shallow water drilling methods and production platforms may be employed. However, in view of the extreme cold and harsh conditions which exist north of the Arctic Circle, the drilling and maintenance of off-shore wells in the Arctic has been extremely difficult. Particularly since the Arctic Ocean is covered with an ice sheet for a good portion of the year. The ice sheet may typically be five to six feet in depth, and and eight to ten foot sheet is not uncommon. Further, the Arctic ice sheet is characterized by extreme irregularities resulting from deformations thereof. One form of ice sheet irregularity is called a pressure ridge, which is normally a long narrow section of ice which has been built up to be many times thicker than the thickness of the surrounding ice sheet. Pressure ridges sometimes extend fifteen feet or more above the surface of the ice sheet and fifty feet or more below the surface. The movement of the ice sheet depends upon its location in the Arctic. At some locations the ice sheet moves only slightly, while at others movements of up to one mile per day, at a rate of up to five miles per hour, are not uncommon. Under these conditions, the present invention was conceived to support a drill string in the Arctic, while protecting it from damage caused by movement of the ice.

SUMMARY OF THE INVENTION

In accordance with a preferred embodiment, a system is disclosed for protecting an object in a frozen waterway from possible damage caused by ice movement. The system includes a protective structure positioned between the object and the ice and having a moon pool therein in which the object is immersed. The protective structure has a deflecting means on its bottom for deflecting downward any ice passing underneath it with the downward deflection causing the ice to break into pieces. The ice pieces then float into the moon pool from which they may be removed. Further, the preferred embodiment includes a protective barrier positioned immediately around the object in the moon pool to protect it from possible damage caused by direct contact with the ice pieces. Also, in the preferred embodiment the protected object is a drill string, and the protective structure is a drilling vessel supporting the drill string. Further, the drilling vessel includes an ice melting system for melting any ice coming into direct contact therewith, and further includes a channel extending from the moon pool to the surrounding waterway through which pieces of ice in the moon pool may be flushed out.

DETAILED DESCRIPTION OF AN EMBODIMENT

Figure 1:
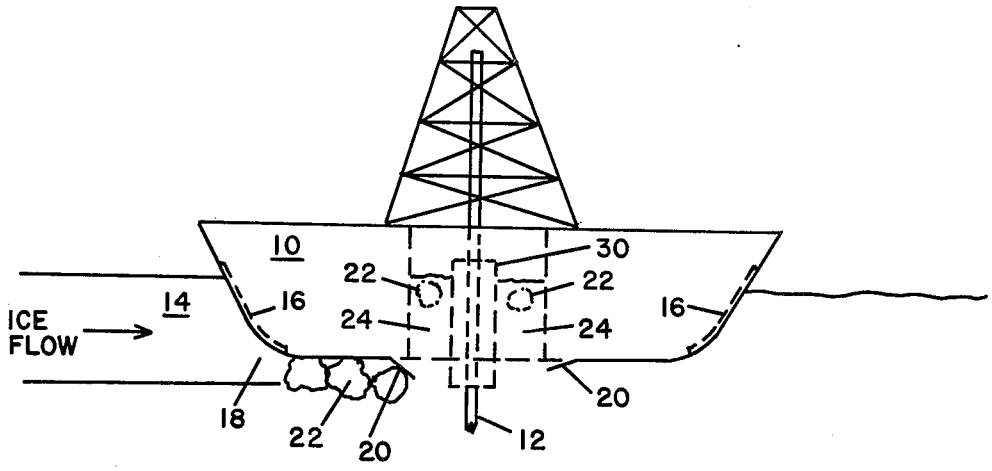
FIG. 1 is a side view of a vessel equipped with the ice removal system of the present invention.
Figure 2:
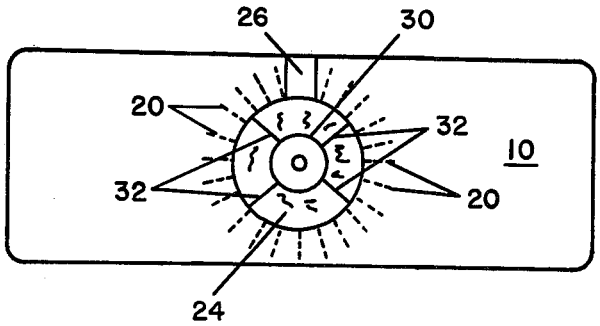
FIG. 2 is a top view of the same vessel but with the drilling rig removed.

Referring to FIG. 1, there is illustrated a protective structure 10 in the form of a vessel or barge which surrounds a protected object in the form of a drill string 12. The drill string may be utilized for the exploration for or production of oil and natural gas.

As shown in FIG. 1, an ice sheet 14 is moving from left to right relative to the stationary vessel 10. The craft 10 has an ice removal system in the form of an ice melting system 16 around its periphery which melts ice as it comes into contact therewith. Ice melting systems on sides of vessels have been discussed in publications, and Arctic Engineers Division of Global Marine, Inc. has proposed an ice melting system for the side of a hovercraft drilling barge. In one embodiment, an ice melting system may be simply heat exchanger tubes mounted adjacent to the vessel hull. A hot fluid is pumped through the tubes to heat the hull and melt the ice as it comes into contact therewith. If the drill string is being utilized in the production of natural gas, then natural gas from the well may supply the heat for the ice melting system. Alternatively, the ice melting system may be replaced by a mechanical ice cutting system, such as is being considered by Sedco, Inc. of Dallas, Tex.

Figure 3:
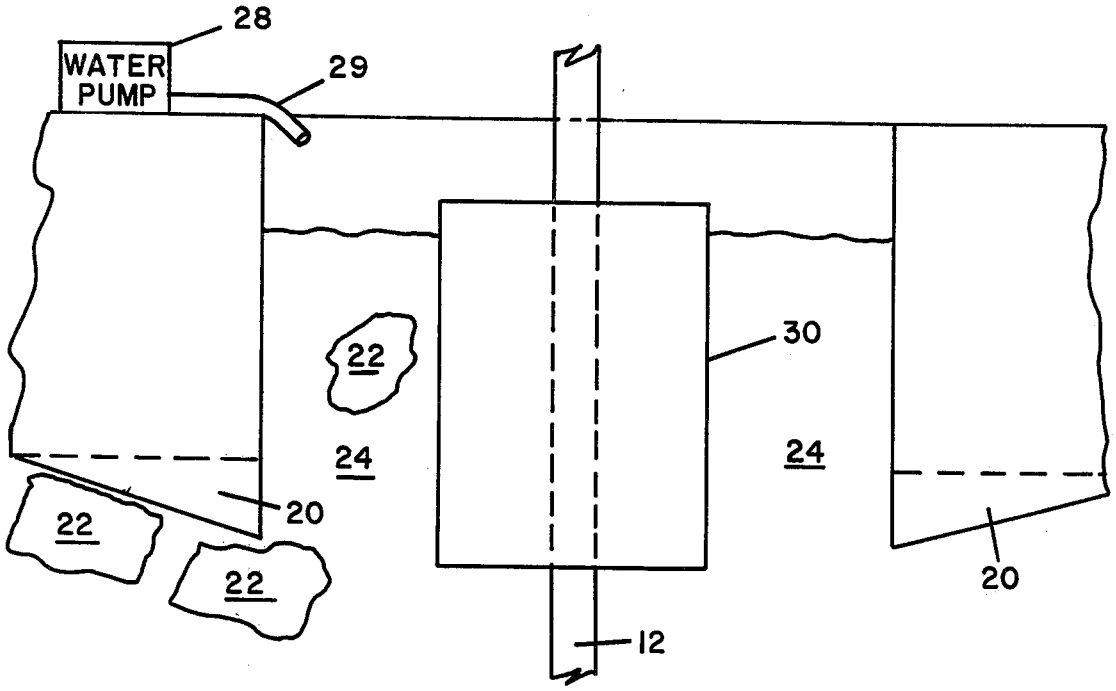
FIG. 3 is an enlarged view of the ice removal system.

With either an ice melting or an ice cutting system, there is a problem when the thickness of the ice sheet exceeds the thickness of the ice being removed. This is illustrated at 18 in FIG. 1, and if no provision were made for this contingency, ice would pass beneath the vessel into direct contact with the drill string 12 and possibly cause substantial damage thereto. The present invention was conceived for that contingency and operates as follows. The section 18 of the ice sheet which passes under the vessel 10 comes into contact with a number of ice breaking ridges 20 which are placed radially around the drill string (in an annular shape). The ice breaking ridges may be simply triangular shaped plates welded to the hull bottom radially around the moon pool. Alternatively, the ice deflector may be one frustro-conical steel plate welded to the hull bottom around the moon pool. Movement of the ice sheet causes the section 18 to come into contact with these ice breaking ridges which deflect the moving sheet downward causing it to fail in tension and breaking it up into a number of ice chunks or blocks 22. These ice blocks 22 are then pushed into a moon pool 24 which surrounds the drill string. The vessel also includes a channel 26 providing open communication between the moon pool 24 and the surrounding sea. As shown in more detail in FIG. 3, a water pump 28 supplies a stream of water through a nozzel 29 to the moon pool 24 to cause water to flow out through channel 26, which results in a continuous flushing of the ice chunks 22 out of the moon pool and into the surrounding sea. This removal system also results in some melting of the ice chunks. A cylindrically shaped protective barrier 30 is positioned in the moon pool immediately around the drill string 12 to protect it from direct contact with the ice chunks. This protective barrier, which may be a cylindrically shaped metal plate, may be held in place by a number of radially positioned struts 32.

Although the structure 10 is shown as a floating vessel, the teachings of this invention might be used on other types of structures, such as a drilling platform or any other structure encountering the problem for which the present invention was developed. Although at least one embodiment of the present invention has been described, the teachings of this invention will suggest many other embodiments to those skilled in the art.

The Invention claimed in:

1. A system for protecting an object in a frozen waterway from possible damage caused by ice movement, and comprising:

a. a protective structure positioned between the object and the moving ice and having a moon pool therein in which the object is immersed;

b. said protective structure having deflecting means, on its bottom and directly adjacent to said moon pool, for breaking by deflecting downward any ice passing under the protective structure, whereby the downward deflection of the ice causes it to break into pieces which then float into said moon pool from which they may be removed, c. and wherein said protective structure includes a channel extending from said moon pool to the surrounding waterway, whereby pieces of ice in the moon pool may be flushed out said channel into the surrounding waterway.

2. A system as set forth in claim 1, and further including a protective barrier positioned in said moon pool and surrounding the object, whereby pieces of ice floating in the moon pool will not come into direct contact with the protected object and possibly cause damage.

3. A system as set forth in claim 1 wherein said deflecting means includes a plurality of radially extending fins on the bottom of the protective structure and surrounding the moon pool.

4. A system as set forth in claim 1 wherein said protective structure includes an ice removal system for removing ice coming into contact therewith.

5. A system as set forth in claim 1 wherein the protected object is a drill string.

6. A system as set forth in claim 5 wherein said protective structure is a ship.

7. A system as set forth in claim 6 wherein said ship includes an ice removal system for removing ice coming into contact therewith.

8. A system as set forth in claim 7, and further including a protective barrier positioned in said moon pool and surrounding the object, whereby pieces of ice floating in the moon pool will not come into direct contact with the protected object and possibly cause damage.

9. A system as set forth in claim 8 wherein said protective structure includes a channel extending from said moon pool to the surrounding waterway, whereby pieces of ice in the moon pool may be flushed out said channel into the surrounding waterway.

10. A system as set forth in claim 9 wherein said deflecting means includes a plurality of radially extending fins on the bottom of the protective structure and surrounding the moon pool.

* * * * *